United States Patent [19]

Palmer

[11] Patent Number: 4,643,324

[45] Date of Patent: Feb. 17, 1987

[54] WASTE BIN HAVING FIRE PREVENTING LID

[75] Inventor: Eric Palmer, Blackpool, England

[73] Assignee: Glasdon Limited, Lancashire, England

[21] Appl. No.: 841,450

[22] Filed: Mar. 19, 1986

[51] Int. Cl.[4] ..... B65D 25/00

[52] U.S. Cl. ..... 220/88 R

[58] Field of Search ..... 220/88 R, 88 A, 1-7, 220/256

[56] References Cited

U.S. PATENT DOCUMENTS

| | | | |
|---|---|---|---|
| 1,832,056 | 11/1931 | Spencer | 220/88 R |
| 3,206,061 | 9/1965 | Feldman | 220/88 R |
| 4,073,401 | 2/1978 | Pecchenino | 220/88 R |
| 4,182,459 | 1/1980 | Williams | 220/88 R |
| 4,212,407 | 7/1980 | Liydon | 220/88 R |
| 4,361,247 | 11/1982 | Williams | 220/88 R |

*Primary Examiner*—George T. Hall

*Attorney, Agent, or Firm*—Roylance, Abrams, Berdo & Goodman

[57] ABSTRACT

The disclosure relates to a waste bin having an inner steel container for refuse and an outer thermoplastic hood form cover having a domed top wall and side ports through which refuse may be deposited in the container. A lid for the container is mounted on the underside of the top wall of the cover and is supported on a central stud extending through the cover by means of a polythene washer held on the stud by a nut. If a fire should develop in the container the resulting heat will cause the washer to melt releasing the cover to fall onto the top of the container therefore preventing air flow into the container to restrict and extinguish the fire.

8 Claims, 5 Drawing Figures

WASTE BIN HAVING FIRE PREVENTING LID

BACKGROUND OF THE INVENTION

1. Field of the Invention

This invention relates to waste bins and is particularly concerned with waste bins comprising a container and a cover extending over the container with a top wall of the cover spaced above the open top of the container and port of ports in the side wall of the cover through which refuse may be placed in the container.

2. Prior Art

Fire is always a problem with litter bins whether deliberately or inadvertently induced and is a particular problem in connection with litter bins formed from thermoplastics material. A common partial solution is to use a steel open topped liner mounted inside a thermoplastics outer cover and whilst such an arrangement may contain a small fire of short duration, with more substantial longer lasting fires, irreversible damage is usually done to the plastics outer cover and particularly so in the case where the cover is of hood form enclosing the top of the container with only ports in the cover through which refuse may be placed in the container.

SUMMARY OF THE INVENTION

This invention provides a waste bin having a container and a cover extending over the container top having a top wall spaced above the container with a port of ports in the side of the cover above the container through which refuse may be placed in the bin, a lid for the container and heat responsive means for supporting the lid adjacent the underside of the top wall of the cover to release the lid in response to a rise in temperature caused by a fire within the container and thereby allow or cause the lid to move downwardly on to the container to close or substantially close the top of the container to extinguish the fire therein by preventing or restricting air flow into the container.

Thus the construction according to the invention reduces the risk of destruction of the outer plastics cover of a bin due to fire by providing a lid supported by heat responsive means for closing the top of the container if a fire should become established in the container by the action of the heat from the heat responsive device supporting the lid to cut of the supply of oxygen to the fire and thereby cause the fire to self-extinguish.

The heat activated responsive means may embody a component which melts, breaks or deforms at a temperature between ambient and that at which prolonged exposure would damage the outer container, so releasing the container lid. Alternatively, release could be effected by a heat activated mechanical latch working, for example, on a bi-metallic strip principal. In the former case, the heat damaged responsive device could be replaced in order to re-mount the container lid in the cover but in the latter case, the extinguisher plate retaining latch would be un-damaged and might be re-set after cooling.

DESCRIPTION OF THE PREFERRED EMBODIMENTS

Figure 1:
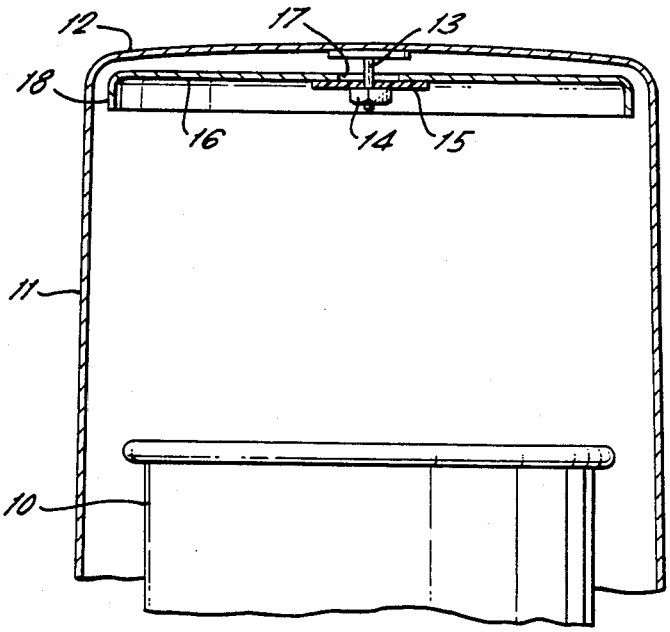
FIG. 1 is a diagrammatic sectional view through the upper part of a wast bin in normal use.
Figure 2:
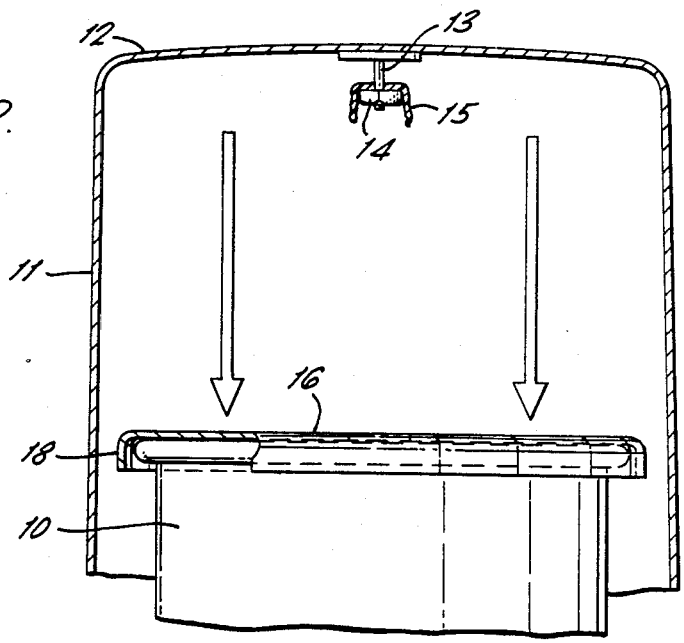
FIG. 2 is a similar view showing the waste bin after a fire has occured.

Referring firstly to FIG. 1 of the drawings, there is shown a waste bin comprising an inner steel container or liner 10 for receiving refuse and an outer thermplastic hood form cover 11 the upper end of which extends over the top of the upper end of the liner and has a domed top wall 12. The side wall of the cover 11 between the top of the container and top wall 12 is formed with one or more ports through which refuse may be placed in the liner.

A flanged stud 13 is mounted at the centre of the top wall 12, the lower end of the stud being screw threaded to receive a steel nut 14 which supports a large diameter polythene washer 15 at the lower end of the stud. The washer in turn supports a lid 16 for the container 10 adjacent the top wall 12, the lid having a central aperture 17 thought which the stud 13 passes and the washer 15 supporting the lid around the outer periphery of the aperture. The lid 16 has a down-turned peripheral flange 18 to engage over the top of the container.

If a fire develops in the container 10, the heat from the fire will eventually each the washer causing the latter to melt and release the lid 16 which then falls onto the container 10 to close the top of the container and, by preventing air flow into the interior of the container, the fire therein is extinguished.

In an alternative construction lowering of the lid onto the container in the vent of a fire could be effected by a heat responsive mechanical device working, for example, as a bi-metallic ship principal. Such a device would not be permanently damaged when operated and so could be re-set after cooling as distinct from the thermoplastic washer of the arrangement described above.

Figure 3:
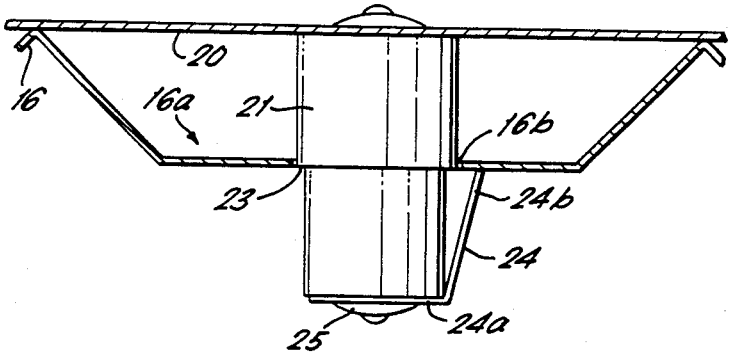
FIGS. 3 to 5 illustrate a further construction.
Figure 4:
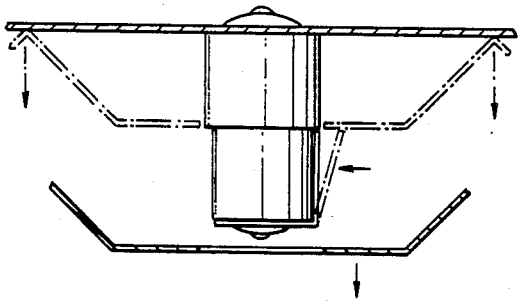
Figure 5:
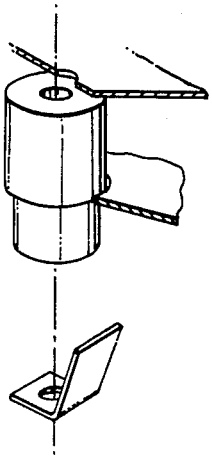

Such an arrangement is illustrated in FIGS. 3 to 5 of the drawings to which reference is now made. A top wall 20 of a waste bin is shown formed in plastics or metal and is generally of similar form to that described with reference to FIG. 1 above. At the centre of the top wall there is a downwardly extending circular section boss 21 secure to the top wall by a through rivet 22. The boss 21 reduces in diameter mid way down the boss to form a downwardly extending annular shoulder 23 encircling the boss. An L-shaped bi-metallic strip 24 has one leg **24*a* secured to the under-side of the lower end of the boss by a rivet 25 and its other leg 24*b*** extends upwardly alongside the lower part of the boss at a shallow divergent angle thereto.

The lid 16 for the container of the waste bin is formed in aluminium and has a dished central area indicated at **16*a*. At the centre of the dish shaped area there is an aperture 16*b* through which the boss 21 extends when the plate is located against the underside of the top wall of the bin. The plate is held against the underside of the top wall of the bin by engagement of the upper end of the leg 24*b* of the bi-metallic strip 24 against the underside of the dished area 16*a* of the plate and in that position the aperture 16*b* in th plate encircles the boss 21 just above the shoulder 23. The bi-metallic strip is constructed such that the outer side of the strip expands to a greater extent when heated than the inner side adjacent the boss. Thus when the bi-metallic strip is heated by a fire in the container below, the strip deflects until it lies against the side of the boss 21 with the upper end of the strip lying underneath the downwardly facing shoulder 23 of the boss as indicated in full line in FIG. 4. The lid 16 is thus released and can fall onto the top of the container to close the container and, by closing off the supply of oxygen, the fire therein is extinquished. After the whole assembly as cooled down, the leg 24***b* of the bi-metallic strip turns outwardly again into the position shown in FIG. 3 and the lid can then be reinstated at the upper end of the bin against the top wall by sliding it over the boss. The bi-metallic sttip is sufficiently resilient to allow the strip to the deflected inwardly by the lid as it is passed over the boss until it clears the upper end of the leg which then springs out to locate under the central region of the lid and support the lid as shown in FIG. 3.

I claim:

1. A waste bin having a container and a cover extending over the container top having a top wall spaced above the container with a port or ports in the side of the cover above the container through which refuse may be placed in the bin, a lid for the container and heat responsive means for supporting the lid adjacent the underside of the top wall of the cover to release the lid in response to a rise in temperature caused by a fire within the container and thereby allow or caused the lid to move downwardly onto the container to close or substantially close the top of the container to extinguish the fire therein by preventing or restricting air flow into the container.

2. A waste bin as claimed in clain 1 wherein the heat responsive element melts, breaks or deforms in response to elevated temperature within the container to allow or cause the container lid to move into engagement with the top of the container.

3. A waste bin as claimed in claim 2 wherein the heat responsive means for supporting the lid adjacent the underside of the top wall of the container comprise a support for the lid mounted on the underside of the top wall of the cover formed from a low melt point material to melt when subjected to excess heat from the container below and release the lid to fall on to the top of the container.

4. A waste bin as claimed in claim 3 wherein the lid has a central aperture and a mounting element to fix to the cover extends downwardly therefrom through the lid and has a low melting point washer mounted at its lower end to engage under and support the lid on the mounting element, the washer melting in response to heat from the container below to release the lid to fall on to the container top.

5. A waste bin as claimed in claim 4 wherein the mounting element comprises a stud having a flange at one end attached to the underside of the top of the cover and a nut at the other end screwed on to the stud to support the low melting point washer thereon.

6. A waste bin as claimed in claim 4 wherein the washer is formed from polythene.

7. A waste bin as claimed in claim 1 wherein the heat responsive mounting means for the lid comprise a heat activated mechanical latch device for allowing the lid to move downwardly from the underside of the cover to the top of the container to close the container when subjected to heat from the container.

8. A waste bin as claimed in claim 7 wherein the heat activated mechancial latch comprises a bi-metallic strip for releasing the lid when subjected to heat from within the container.

* * * * *